United States Patent [19]

Bohman et al.

[11] Patent Number: 4,507,114

[45] Date of Patent: Mar. 26, 1985

[54] MULTIPLE CHAMBER CONTAINER HAVING LEAK DETECTION COMPARTMENT

[75] Inventors: Paul Bohman, Wildwood; John Hart, Winnetka; Gene Fabisiewicz, Mt. Prospect, all of Ill.

[73] Assignee: Baxter Travenol Laboratories, Inc., Deerfield, Ill.

[21] Appl. No.: 544,190

[22] Filed: Oct. 21, 1983

[51] Int. Cl.[3] ..... B65D 25/08; B65D 81/32

[52] U.S. Cl. ..... 604/111; 604/87; 604/404; 604/410; 604/416; 206/219; 206/459; 73/49.3

[58] Field of Search ..... 604/56, 82, 87, 89, 604/91, 92, 111, 404, 408, 409, 410, 414–416; 206/219, 459; 73/49.3

[56] References Cited

U.S. PATENT DOCUMENTS

| | | | |
|---|---|---|---|
| 3,343,541 | 9/1967 | Bellamy, Jr. | 604/111 |
| 3,985,135 | 10/1976 | Carpenter et al. | 128/214 D |
| 4,187,798 | 2/1980 | Yoshimura | 73/49.3 |
| 4,235,332 | 11/1980 | Andersen et al. | 206/219 |
| 4,340,049 | 7/1982 | Munsch | 128/214 |
| 4,396,383 | 8/1983 | Hart | 604/56 |
| 4,410,026 | 10/1983 | Boggs et al. | 604/408 |
| 4,410,321 | 10/1983 | Pearson et al. | 604/410 |
| 4,439,192 | 3/1984 | Leurink | 604/415 |
| 4,458,733 | 7/1984 | Lyons | 604/410 |
| 4,465,488 | 8/1984 | Richmond et al. | 604/414 |
| 4,467,588 | 8/1984 | Carveth | 604/410 |

FOREIGN PATENT DOCUMENTS

| | | | |
|---|---|---|---|
| 0620830 | 12/1980 | Switzerland | 604/410 |

*Primary Examiner*—C. Fred Rosenbaum
*Assistant Examiner*—Michelle N. Lester
*Attorney, Agent, or Firm*—Paul C. Flattery; John P. Kirby, Jr.; Bradford R. L. Price

[57] ABSTRACT

A container (34) includes first and second chambers (40, 42) for the storage of two substances (44, 46) such as medical liquids. The chambers are separated by a chamber-communicating assembly (61) which is selectively opened by an operator for mixture of the two substances and delivery to a patient. A leak detection compartment (62) encloses the assembly (61) between the two chambers, including a periperhal channel (76) and ridges (80) on the assembly (61).

When seal integrity between the container wall sheets (36, 38) and the assembly (61) is less than complete, the leak detection compartment both prevents liquid in one chamber from entering the other through the leak pathway and also assures detection of the leak during the manufacturing operation.

10 Claims, 5 Drawing Figures

MULTIPLE CHAMBER CONTAINER HAVING LEAK DETECTION COMPARTMENT

TECHNICAL FIELD

The present invention relates to multiple chamber solution containers and more particularly relates to a flexible container construction for medical solutions which facilitates inspection of chamber seal integrity.

BACKGROUND OF THE INVENTION

It is known to provide multiple chamber flexible plastic containers for the separate storage of two substances, particularly medical substances, in a closed environment. Immediately before use, two or more chambers are placed in open communication for mixing of the substances, which are then typically delivered intravenously to a patient through an administration set secured to the container.

Such a container is shown in U.S. patent application Ser. No. 246,479, assigned to the assignee of the present invention, filed Mar. 23, 1981, to Richmond, et al. and now U.S. Pat. No. 4,465,488, which discloses a container made from flexible plastic sheeting separated into two individual chambers by means of a heat seal. A pathway is defined between the chambers by a flexible plastic tube having a frangible closure therein. The frangible closure is also shown in U.S. Pat. No. 4,340,049 to Munsch. When the frangible closure is broken, the two chambers are placed in fluid communication through the tube. The tube prevents the opened frangible closure from floating freely within one of the chambers. In addition, openings may be made in the tube to facilitate fluid flow upon opening of the closure.

Another multiple chamber, flexible-walled container suitable for the separate storage of two liquids is described in U.S. Pat. No. 4,396,383 to Hart, assigned to the assignee of the present invention.

Such multiple chamber medical fluid containers are especially useful for storing and mixing two supply solutions which when mixed form a single medical solution which itself is unsuitable for storage over extended time periods. Examples of medical substances which may not be combined until just prior to use include (1) dextrose solution and heparin and (2) dextrose solution and amino acids. There are many other medical liquids which may not be combined until just before delivery. to the patient.

The double chamber container is advantageous in that it provides a closed system for mixing the two liquids, eliminating the chance of contamination which would otherwise be present if the two medical substances were to be combined from two separate sources, such as might be done in a hospital pharmacy.

From the above it is readily apparent that because of the nature of the medical substances involved, virtually absolute separation of the two substances must be maintained during storage.

Flexible plastic containers such as the single chamber VIAFLEX® container sold by Travenol Laboratories, Inc. of Deerfield, Ill., provide a cost effective means for solution storage. Various plastics can be used, such as polyvinyl chloride sheeting. Two sheets of the plastic may be effectively sealed by such means as a heat seal to form the container. However, because of the criticality of preventing each of the medical substances from contacting the other during storage, it is especially desirable in multiple chamber containers to have a positive means for detecting the presence of any leak between the chambers caused by an improper seal between the flexible sheeting and the tube communicating between the chambers.

SUMMARY OF THE INVENTION

The present invention is directed to a multiple chamber container having a leak detection compartment. Flexible plastic sheeting defines first and second chambers, at least one of which contains a liquid substance. A chamber-communicating means is disposed between the first and second chambers and defines a selectively openable flow path between the chambers. A normally empty leak detection compartment encloses the chamber-communicating means between the two chambers, providing two related principal advantages. Any. liquid which leaks between the chamber-communicating means and the outer container wall formed by the sheeting enters the leak detection compartment, enabling the liquid to be detected by various means, such as visual inspection. Also, liquid which leaks out of one chamber is prevented from entering the other chamber.

The leak detection compartment may include permanent openings such that liquid passing into the compartment immediately passes out of the container into an overpouch typically used as a dust cover. In the preferred embodiment leaks may be detected by visual inspection for moisture in the overpouch after autoclaving of the container.

The present invention is further directed to a method of detecting a leak in a multiple chamber container.

DETAILED DESCRIPTION OF THE PREFERRED EMBODIMENTS

Figure 1:
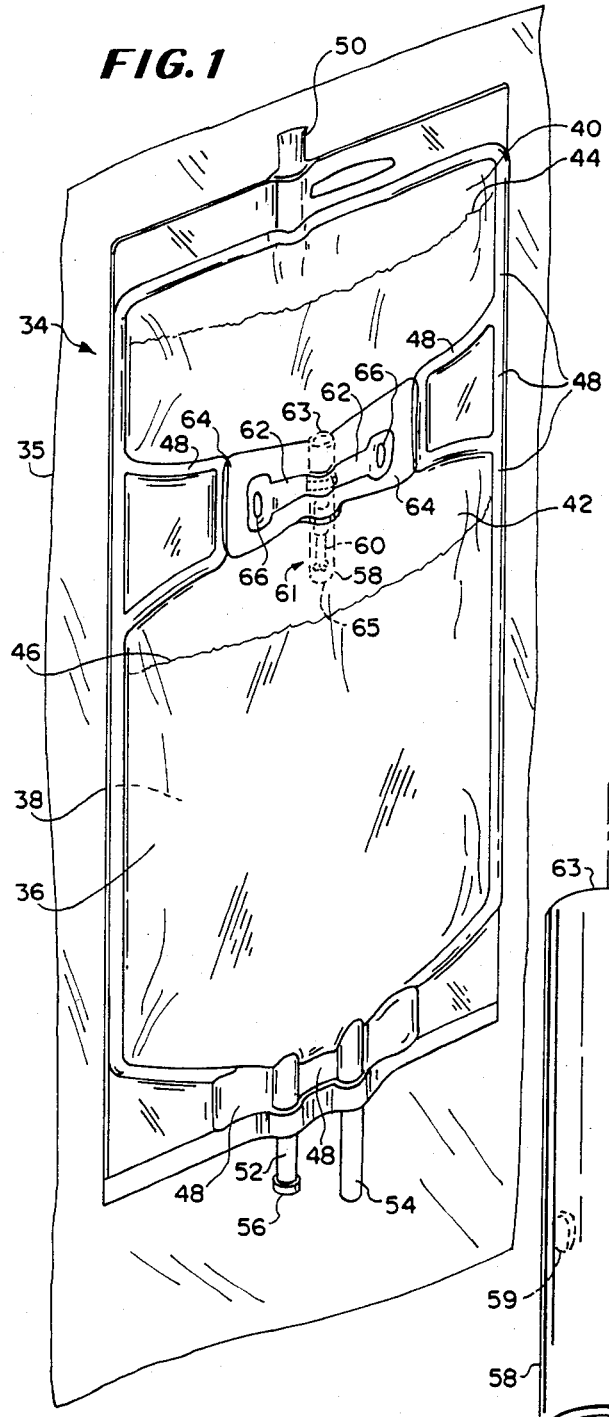
FIG. 1 is a perspective view of the container of the present invention.

The container 34 of the present invention is illustrated in FIG. 1. The container 34 is stored within an overpouch 35 and has a container wall formed from flexible plastic sheets 36, 38 which define first and second chambers 40, 42. The chambers 40, 42 contain first and second substances 44, 46, respectively. At least one of the substances 44, 46 is a liquid. In the drawing, both substances are liquids. For example, the first substance 44 may be heparin and the second substance 46 may be dextrose solution.

The two sheets 36, 38 are sealed together such as by a heat seal 48 to further define the container wall and the first and second chambers 40, 42.

A first chamber fill port 50 communicates with the first chamber 40. An injection site 52 and an administration port 54 communicate with the second chamber 42. First fill port 50, injection site 52 and administration port 54 are disposed and secured between the first and second sheets 36, 38 in conventional manner by heat sealing the sheets about the tubes comprising the ports 50, 54 and the injection site 52.

The injection site 52 includes a polyisoprene situs 56 which may be pierced by a needle for addition of medicament. The administration port 54 may include a pierceable diaphragm (not shown) which is pierced by the spike or cannula of a parenteral fluid administration set.

Figure 2:
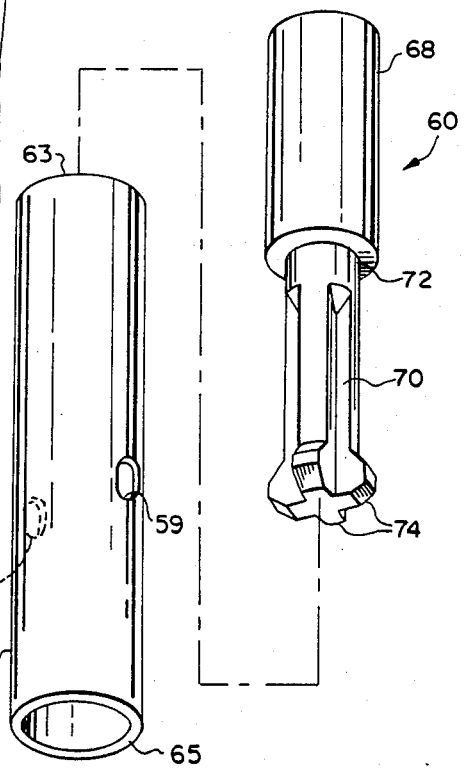
FIG. 2 is an exploded view of a chamber-communicating means, including the flexible plastic tube and the frangible closure.
Figure 3:
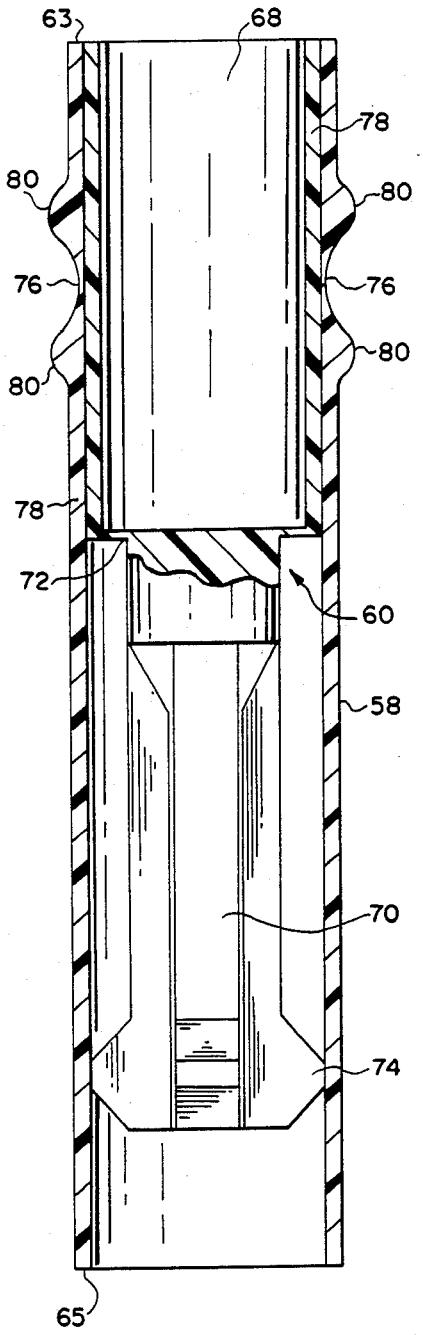
FIG. 3 is a perspective view of the assembled chamber-communicating means.

Chamber-communicating means is disposed between the first and second chambers 40, 42. In the preferred embodiment the chamber-communicating means is the chamber-communicating assembly 61, which is best shown in FIGS. 2 and 3. The assembly 61 includes a flexible tube 58 in which is mounted a frangible closure 60. The assembly 61 is sealed between the sheets 36, 38. The heat seal 48 between the flexible plastic sheets 36, 38 is a strong, secure seal. However, the heat seal portion 64 about the flexible tube 58 is both a harder seal to make, because of seal conformance to a circular configuration, and a more critical seal to maintain, because it effectively separates the substances 44, 46 in the top and bottom chambers 40, 42. Because of the need for the heat seal portion 64 between the otherwise substantially parallel sheets 36, 38 to conform to a circular cross-sectional configuration, the chances for leakage between the sheets 36, 38 and the tube 58 are increased.

A leak detection compartment 62 is disposed between and partially defined by the flexible sheets 36, 38, between the first and second chambers 40, 42. The sheets 36, 38 form the wall of the detection compartment 62. The leak detection compartment encloses the chamber-communicating means which in the preferred embodiment is the assembly 61. The leak detection compartment 62 is defined by a seal such as the heat seal portion 64 between the first and second sheets 36, 38 and between each of the sheets and the tube 58. The leak detection compartment 62 in the preferred embodiment includes defined openings 66 in the first and second sheets 36, 38 to the container-exterior. However, only one opening 66 is necessary in this embodiment and it may be limited to only one of the two sheets.

Referring now to FIGS. 2 and 3 in more detail, illustrating the chamber-communicating assembly 61, there is shown the flexible tube 58 having first and second ends 63, 65 and the frangible closure 60. The frangible closure 60 includes a hollow, tubular portion 68 and a stem 70 integral with the hollow, tubular portion 68 at a thin wall portion 72. The frangible closure 60 is mounted in the tube with the hollow tubular portion 68 near the first tube end 63 and with the stem 70 near the second tube end 65. The tube 58 may include sidewall openings 59 around the stem 70 of the frangible closure 60 for increased fluid flow rate after the frangible closure 60 has been broken. Upon placement in the flexible tube 58, the frangible closure 60 acts as a valve. Bending of the tube 58 from outside the container 34 breaks the closure 60 at the thin wall portion 72, allowing fluid to flow through the tube 58 around the stem 70, through the inside of the hollow tubular portion 68 and through the first and second ends 63, 65 and sidewall openings 59. The stem 70 includes extended vanes 74 which press against the inside wall of the tube 58 to maintain the stem 70 within the tube even after the stem is broken away from the hollow tubular portion 68.

In addition to a friction fit between the hollow tubular portion 68 and the tube 58, it is desirable to seal these two elements together so as to prevent any fluid flow through the tube 58 before the frangible closure 60 is broken. This seal is accomplished in a manner which not only provides a proper seal between the tube 58 and the frangible closure 60, but in the preferred embodiment of the invention also serves to facilitate the functioning of the leak detection compartment 62. The closure 60 and tube 58 may be sealed together by inserting a metal mandrel within the hollow tubular portion 68 and bringing a sealing die (not shown) of conventional construction around the tube 58 opposite the hollow tubular portion 68. The use of radiofrequency energy will create an RF seal between the hollow tubular portion 68 and the tube 58. Typically, RF seals are formed by the application of pressure as well as by RF energy. The application of sufficient pressure forms an indentation or channel 76 in the sidewall 78 of the tube 58, about the entire circumference of the tube, and corresponding ridges 80 in the sidewall 78 on both sides of the channel 76. As will be seen below, the presence of the channel 76 and ridges 80 is highly desirable in the container of the invention.

Figure 4:
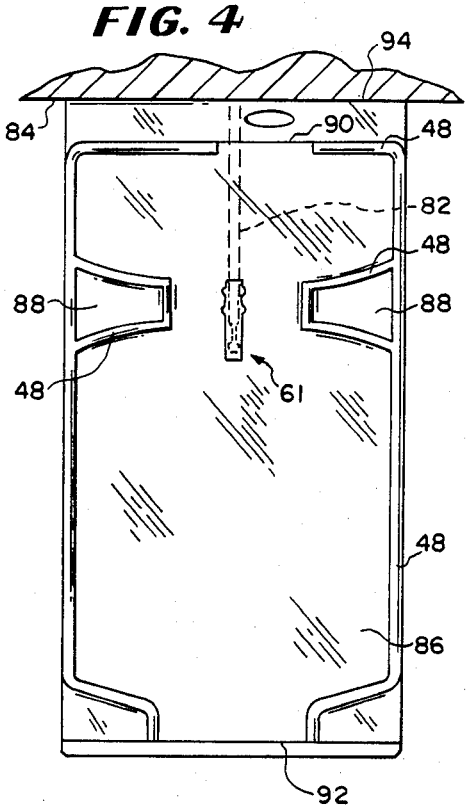
FIG. 4 is a top plan view of the manufacturing procedure for the container.

After manufacture of the assembly 61, it is mounted on a mandrel 82 extending from a stop 84, as seen in FIG. 4. The hollow tubular portion 68 rests about the mandrel 82. A container subassembly 86 is then loaded about the mandrel 82. The container subassembly 86 includes the majority of the peripheral heat seal 48 as well as portions of the heat seal 48 which define the interior walls of the first and second chambers 40, 42. The container subassembly 86 may include void areas 88 which serve to further separate the first and second chambers 40, 42. The container subassembly 86 also includes a first chamber opening 90 and a second chamber opening 92 at which the first and second sheets 36, 38 are not yet sealed.

The container subassembly 86 is mounted about the mandrel 82 with the mandrel 82 extending through the first chamber opening 90. The container subassembly 86 is urged onto the mandrel, with the assembly 61 thereabout, until the first chamber end 94 of the container subassembly 86 hits the stop 84. Proper sizing of the container length, the mandrel length and stop assure that the assembly 61 is accurately placed within the container subassembly 86.

Figure 5:
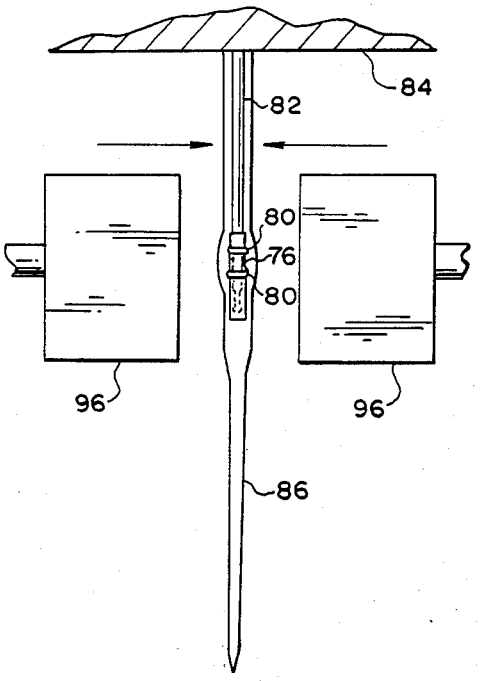
FIG. 5 is a side elevational view of the manufacturing procedure for the container.

As seen in FIG. 5, heat seal dies 96 are then urged against both of the flexible sheets 36, 38 to form the seal portion 64 which defines the leak detection compartment 62. The heat seal portion 64 extends from the heat seal 48 previously made on the container subassembly 86. The dies 96 form the seal 64 about the entire circumference of the tube 58, between the tube 58 and the flexible sheets 36, 38, as well as between the flexible sheets 36, 38 themselves. The seal portion 64 thus formed completely separates the first and second chambers 40, 42.

As mentioned above, the assembly 61 is fairly precisely placed within the container subassembly 86. This is to ensure that the channel 76 about the entire circumference of the tube 58 is within the compartment 62 defined by the heat seal 64. Thus, within the compartment 62 the flexible sheets 36, 38 do not contact the tube 58. The compartment 62, although disposed on both sides of the tube 58 as seen in FIG. 1, is one contiguous volume.

After the assembly 61 and container subassembly 86 are assembled, the first chamber fill port 50, the injection site 52 and the administration port 54 may be inserted between the sheets 36, 38 and sealed thereto in conventional manner. The first chamber 40 may be filled with the first substance 44 through the tube 50, which may then be permanently sealed, such as by a heat seal. The second chamber 42 may be filled with the second substance 46 through either the injection site 52 or administration port 54 before final closure of the site 52 and tube 54.

In the preferred embodiment of the invention, the leak detection compartment 62 includes opening 66 to the container-exterior. These may be formed anytime after formation of the compartment 62 itself by a cutting or punching operation.

After the container is completely manufactured and filled and sealed, it is ready. for autoclaving, which is a common means for sterilizing medical liquids. Typically, flexible plastic medical solution containers are placed in plastic overpouches. These overpouches serve as dust covers and/or moisture transmission barriers to limit moisture loss from the container through the container wall during extended storage periods. The overpouch 35 is then typically sealed with the container therein and placed in an autoclave where it is subjected to a temperature of about 250 degrees Fahrenheit for a period of about one hour, for example, to sterilize the container contents. The temperature and time may vary, especially depending on the volume of the container. The steam sterilization under pressure procedure provides the most stringent test of seal integrity for the container. With the containers shown in U.S. Pat. No. 4,396,383 and U.S. Ser. No. 246,479, for example, an improper seal between two chambers could not be detected because liquid flowing between any unintentionally remaining passage between the first and second chambers would simply flow into the other chamber. Thus, any existing leak might not be noticed.

With the container of the present invention any improper seal between the flexible sheets 36, 38 and the flexible tube 58 will be detected because moisture will pass through any seal failure passage into the leak detection compartment 62 and then out the defined openings 66 into the overpouch 35, where the moisture may be visually detected after the steam sterilization cycle has been completed. Typically, the overpouches are clear enough to detect the collection of any moisture within the pouch. Those containers which do not have moisture within the overpouches have a proper seal between the tube 58 and the sheets 36, 38.

The container 34 of the present invention may be utilized by the end user, such as a nurse or other hospital personnel, by bending the tube 58 from outside the container 34 as described above. Alternate compression of the chambers 40, 42 forces liquid between the chambers, through the flexible tube. This action mixes the two substances, which may then be delivered as a single homogenous solution through the administration port 54.

In an alternative embodiment of the invention, the defined openings 66 are not provided. Moisture passing through any improper seal about the tube 58 will be retained in the leak detection compartment 62 instead of passing into the overpouch 35. This embodiment may not be preferred from the point of view of leak detection within the manufacturing facility because visual inspection will then have to be made through the wall of the leak detection compartment 62 as well as through the wall of the overpouch. Opening of the overpouch and removal of the container to view the compartment 62 is an extra step and typically the container 34 would be defined as a destroyed product if removal from the overpouch were made after steam sterilization, even though the container contents are sterile.

However, such a configuration would be desirable in order to enable a final leak check by hospital personnel, i.e., hospital personnel could inspect the leak detection compartment 62 for the presence of moisture. If moisture were found, the container would be deemed defective. This alternate embodiment does require that at least that portion of one of the flexible sheets 36, 38 which defines the compartment 62 be substantially optically transparent.

As a further modification, the channel 76 and accompanying ridges 80 in the tube 58 may be eliminated because they are not absolutely necessary; however, they are highly desirable because they do assure an open area around the complete circumference of the tube 58 so that no seal imperfections around the tube 58 can communicate directly between the first and second chambers. The leak detection compartment 62 thereby interrupts any leak pathway between the chambers.

While various embodiments of the present invention have been described in detail herein and shown in the accompanying drawings, it will be evident that various further modifications are possible without departing from the scope of the invention.

What is claimed is:

1. A container for the storage of at least two substances, comprising:

(a) first and second chambers defined by a container wall, at least one of said first and second defined chambers containing a liquid substance;

(b) chamber-communicating means having first and second ends secured to and in communication with said first and second chambers, respectively, said chamber-communicating means defining a selectively openable flow-path between said first and second chambers; and (c) a normally empty leak detection compartment defined by a detection wall, enclosing said chamber-communicating means between said first and second chambers, such that any liquid which unintentionally passes between said chamber-communicating means and said container wall from either of said chambers enters said leak detection compartment, facilitating detection of a leak.

2. The container as in claim 1, wherein said detection compartment wall is optically transparent and said leak detection compartment is closed.

3. The container as in claim 1, further including at least one defined opening in said detection wall, placing said compartment in open communication with the container-exterior.

4. The container as in claim 3, further comprising an overpouch in which said container is stored, such that any liquid which exits said leak detection compartment through said defined opening remains in said overpouch for visual perception by an operator.

5. The container as in claim 1, wherein said chamber-communicating means comprises a chamber-communicating assembly including a flexible tube having first and second ends secured to and in communication with said first and second chambers, respectively, and a frangible closure sealingly mounted within said flexible tube.

6. The container as in claim 5, said chamber-communicating assembly further comprising a channel in a sidewall of said tube, about the entire circumference of said tube, said channel being disposed within said leak detection compartment and interrupting any leak pathway which might otherwise communicate directly between said first and second chambers.

7. A container for the storage of at least two substances, comprising:

(a) first and second chambers defined by a container wall, at least one of said first and second defined chambers containing a liquid substance;

(b) a chamber-communicating assembly including a flexible tube having first and second ends secured to and in communication with said first and second chambers, respectively, and a frangible closure sealingly mounted within said flexible tube, said chamber-communicating assembly defining a selectively openable flow path between said first and second chambers;

(c) a normally empty leak detection compartment defined by a detection wall, enclosing said chamber-communicating assembly between said first and second chambers, said detection wall including at least one defined opening; and (d) a channel about the entire circumference of said flexible tube, said channel being disposed inside said leak detection compartment;

(e) whereby any liquid which unintentionally passes between said chamber-communicating assembly and said container wall from either of said chambers enters said leak detection compartment and exits said compartment through said defined opening, facilitating detection of a leak.

8. The container as in claim 7, further comprising an overpouch in which said container is stored, such that any liquid which exists said leak detection compartment through said defined opening remains in said overpouch for visual perception by an operator.

9. A method for detecting a leak in the container in claim 3, the steps comprising:

(a) sealing the container in a pouch;

(b) autoclaving the container, within the pouch; and (c) thereafter inspecting the pouch interior for the presence of moisture exterior of the container.

10. A method for detecting a leak in the container of claim 2, the steps comprising:

(a) autoclaving the container; and (b) thereafter inspecting the leak detection compartment for the presence of moisture therein.

* * * * *